US005426965A

United States Patent [19]

Hopf

[11] Patent Number: 5,426,965

[45] Date of Patent: Jun. 27, 1995

[54] CARRIAGE BOOST DRIVE

[75] Inventor: Werner G. Hopf, San Marcos, Calif.

[73] Assignee: Eaton Leonard, Inc., Carlsbad, Calif.

[21] Appl. No.: 67,633

[22] Filed: May 25, 1993

[51] Int. Cl.[6] ..... B21D 7/04; B21B 37/12

[52] U.S. Cl. ..... 72/149; 72/151

[58] Field of Search ..... 72/149, 151

[56] References Cited

U.S. PATENT DOCUMENTS

| | | | |
|---|---|---|---|
| 3,974,676 | 8/1976 | Eaton | 72/307 |
| 4,006,621 | 2/1977 | Moshnin et al. | 72/151 |
| 4,063,441 | 12/1977 | Eaton | 72/151 |
| 4,970,885 | 11/1990 | Chipp et al. | 72/8 |
| 5,259,224 | 11/1993 | Schwarze | 72/149 |

FOREIGN PATENT DOCUMENTS

| | | | |
|---|---|---|---|
| 0121720 | 5/1990 | Japan | 72/151 |
| 0290622 | 11/1990 | Japan | 72/149 |

*Primary Examiner*—David Jones
*Attorney, Agent, or Firm*—Pretty, Schroeder, Brueggemann & Clark

[57] ABSTRACT

A boost system (53) traveling behind the carriage (12) of a tube bending machine includes an hydraulic boost cylinder (58) that slidably receives a boost shaft (52) that is connected to the carriage. The boost cylinder has a piston fixed to the boost shaft, and the cylinder is slidably mounted on the machine bed (10) that slidably carries the carriage so that the boost cylinder (58) is carried along with the carriage (12) as the carriage moves toward and away from the bend head (24) mounted at a forward end of the machine bed for positioning a tube (22) to be bent at the bend head. When a bending operation commences, the boost cylinder (58) is locked to the machine bed by a movable pawl (94) that is driven into engagement with a rack (80) fixed to the bed. While the boost cylinder (58) is thus locked to the bed it is pressurized during a bending operation so as to drive the boost shaft (52), and thereby the carriage (12) and the tube (22) carried by the carriage, forwardly to exert a large compressive force on the tube while it is being bent. Upon completion of the bend the pawl (94) and rack (80) are disengaged so that the boost cylinder (58) may travel freely together with the carriage (12).

24 Claims, 6 Drawing Sheets

CARRIAGE BOOST DRIVE

BACKGROUND OF THE INVENTION

1. Field of the Invention

The present invention relates to tube bending machines and more particularly concerns exertion of a boost force to axially compress a tube while it is being bent.

2. Description of Related Art

A common type of tube bending machine employs a slidable tube holding carriage that positions a forward portion of a tube between a clamp die and a rotary bend die. Rotation of both the bend and clamp dies bends the tube around the bend die and pulls it past a pressure die which is positioned against a rearward portion of the tube being bent. The tube tends to stretch as it is bent around the bend die, resulting in thinning of tube walls. To minimize such thinning, a forward compressive force is exerted on the tube as it is bent. This may be accomplished by the hydraulically assisted pressure die, which not only holds the tube in position as it is bent, but also urges the tube forwardly. Under control of a pressure die boost cylinder, the pressure die is caused to move forward, frictionally engaging the tube and frictionally driving the tube axially to thereby exert an axial compressive force on the tube. Exerting of an axial compression force during bending is particularly important in bending of thin-wall tubes.

Because it is a friction type drive, the pressure die boost system can provide only a limited amount of forward force on the tube before it will begin to slip relative to the tube, thereby losing the compressive drive force and marring the tube.

In some systems the carriage itself is driven by an hydraulic cylinder that is fixed to the bed and has a drive shaft that moves the carriage through its total range of movement. However, since the required carriage travel may be as much as ten feet or more for bending of longer tubes, a fixed hydraulic cylinder will have an excessively long shaft, which adds greatly to the mass and weight that must be moved as the carriage moves to position the tube at the bend die. This increased mass and weight slows the desired motion of the carriage and has other disadvantages, such as increased bender bed length.

Rapidly moving carriages are driven by a chain drive or a rack and pinion, which add little mass and enable rapid motion of the carriage to quickly advance the tube to its bending positions. However, chain or pinion drive systems are not capable of exerting sufficiently large drive forces on the carriage. Even where assisted by a pressure die boost system, it is still not possible for such systems to exert adequate compression on certain thin walled tubes.

Accordingly, it is an object of the present invention to provide forward boost of a tube in a bending machine in a manner that avoids or eliminates prior art problems.

SUMMARY OF THE INVENTION

In carrying out principles of the present invention in accordance with a preferred embodiment thereof, boost means are provided for driving a tube held by the carriage toward the bend head. The boost means comprises a boost motor coupled to the carriage for motion together with the carriage relative to the machine bed. Means are provided for selectively preventing motion of the boost motor relative to the machine bed, and means are provided, responsive to operation of the motor, for exerting a forwardly directed boost force on a tube held by the carriage while the tube is being bent. In a specific embodiment an hydraulic boost motor cylinder is slidable on a boost shaft coupled to and extending rearwardly from the carriage. A piston is fixed to the boost shaft within the cylinder. The boost motor cylinder, normally free to move with the carriage, is selectively locked to the machine bed during the bending operation so that pressurization of the boost motor cylinder will drive the boost shaft, carriage and tube forwardly with a sufficiently large boost force.

DETAILED DESCRIPTION

Figure 1:
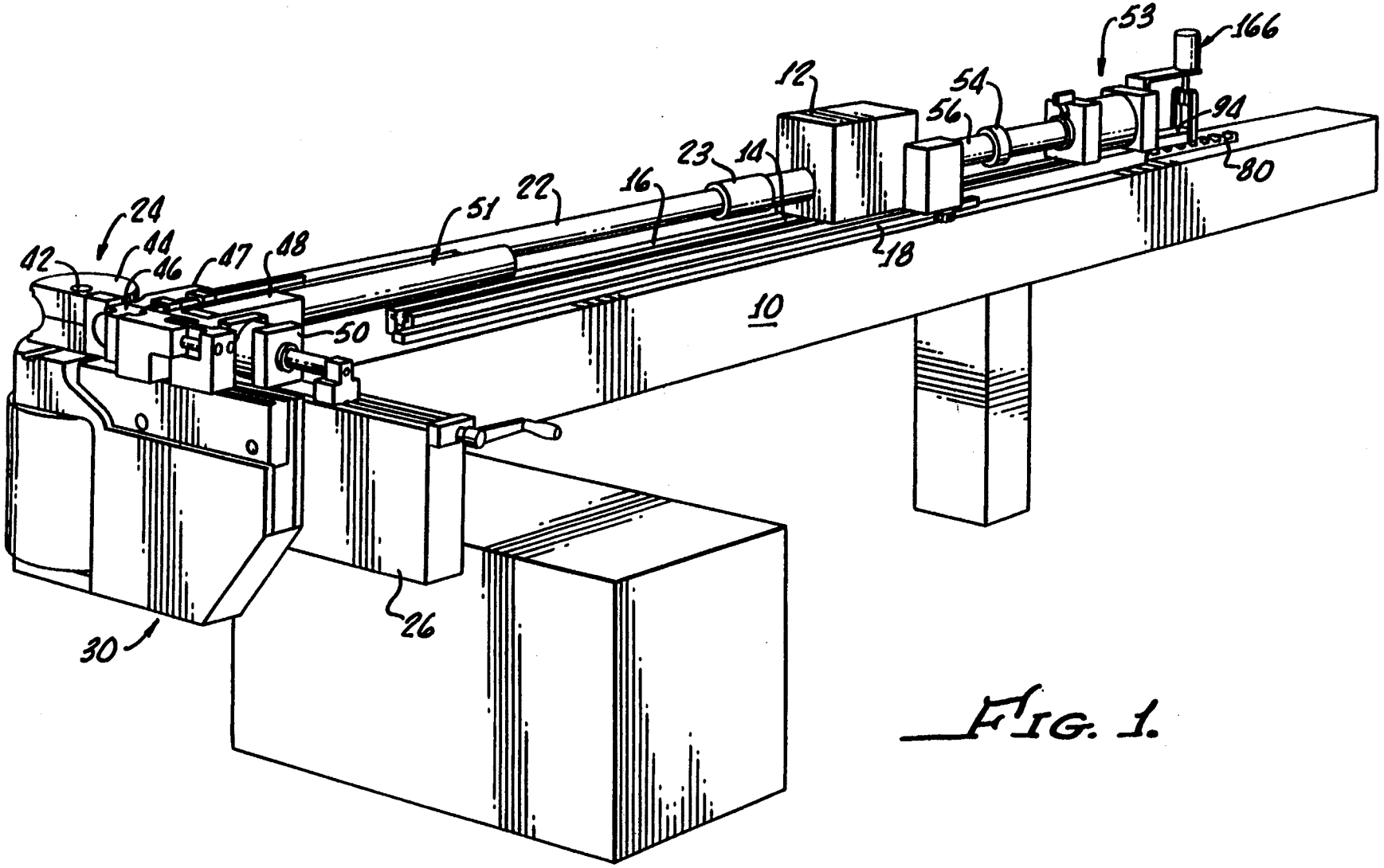
FIG. 1 is a pictorial illustration, with parts not in proportion, of a bending machine having a carriage boost drive that embodies principles of the present invention.
Figure 2:
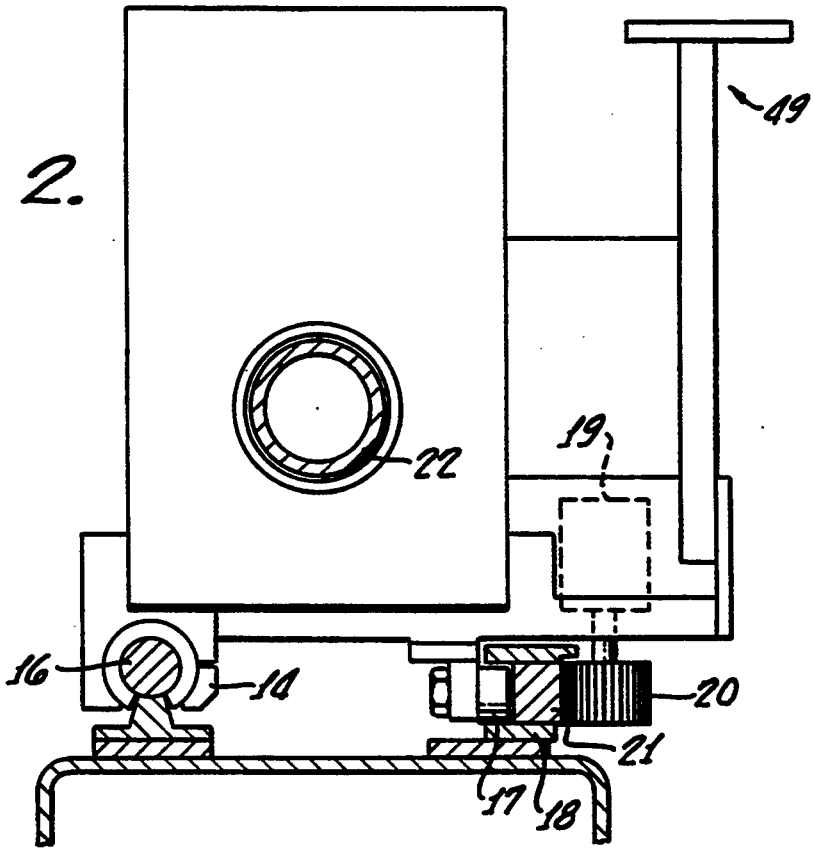
FIG. 2 is a vertical section of the bending machine illustrating features of carriage mounting and drive.

As illustrated in FIGS. 1 and 2 a bending machine bed 10 slidably mounts a carriage 12 by means of a carriage follower, 14 (FIG. 2) fixed to one side of the carriage and slidably mounted on an elongated longitudinally extending guide 16 fixed to the machine bed. The other side of the carriage carries a roller 17 that rolls along a fixed longitudinally extending track plate 18. A carriage drive electric motor 19 is mounted to the side of the carriage and rotates a pinion gear 20 that engages a rack 21 extending longitudinally for the full length of carriage travel. The carriage also carries a chuck 23 holding a tube 22 that is to be bent. The tube 22 extends through the chuck and has its end seated on a seat in the carriage in an arrangement that enables the carriage to press against the end of the tube 22 and exert a longitudinal forwardly directed (toward the left in FIG. 1) force thereon.

At the forward end of the bed 10 is a bend head 24 including a stationary arm assembly 26 and a bend arm assembly 30. The bend arm assembly 30 is rotated by a suitable bend arm drive (not shown) about a vertical axis 42 and carries a bend die 44 to which the tube is clamped by means of a clamp die 46 mounted on the bend arm assembly 30 for motion toward and away from the bend die. The stationary arm assembly 26 carries a pressure die 47 mounted in a bolster 48 that is driven transversely of the tube 22 toward and away from bend die 44 by a pressure die cylinder 50. During a bending operation the pressure die 47 is also driven forwardly, in a direction parallel to the tube axis, by a pressure die boost cylinder 51. A bracket 49 supports flexible and foldable cables (not shown) that carry electric power to electric motors of the carriage and compressed air hoses to operate the chuck drive.

The structure described to this point is well known, and, for example, is basically the same as the structure shown in U.S. Pat. No. 4,063,441 for Apparatus for Bending Tubes.

In use of the apparatus described to this point a tube 22 mounted in the chuck and carriage is advanced toward the bend head by operation of the carriage drive motor 19 until an end of the tube that is to be bent is properly positioned with respect to the bend die 44. Thereupon the clamp die 46 is moved toward the tube to clamp it tightly against the bend die 44, and similarly the pressure die 47 is moved toward the tube to press it toward the bend die. To perform a bend the entire bend arm assembly 30, together with clamp die 46 and bend die 44, are rotated about the vertical axis 42 of the bend die to bend the tube around the circular bend die, pulling the tube forwardly as the bend die rotates. During this bending operation the carriage drive is disabled and the carriage is free to slide along the carriage guide rail. At the start of the bend the pressure die may also be driven forwardly by actuation of the pressure die boost cylinder 51. Because the pressure die also clamps a portion of the tube against the bend die, forward motion of the pressure die will frictionally engage the tube and drive it forwardly with the pressure die, thereby providing some compressive force on the tube and helping to some extent to alleviate tube wall thinning during the bending operation. However, to sufficiently reduce wall thinning in some bending operations larger compressive forces must be exerted on the tube as it is being bent. Most bending apparatus, including bending apparatus of the type shown in U.S. Pat. No. 4,063,441, are not capable of exerting such forces without specially provided boost.

Figure 3:
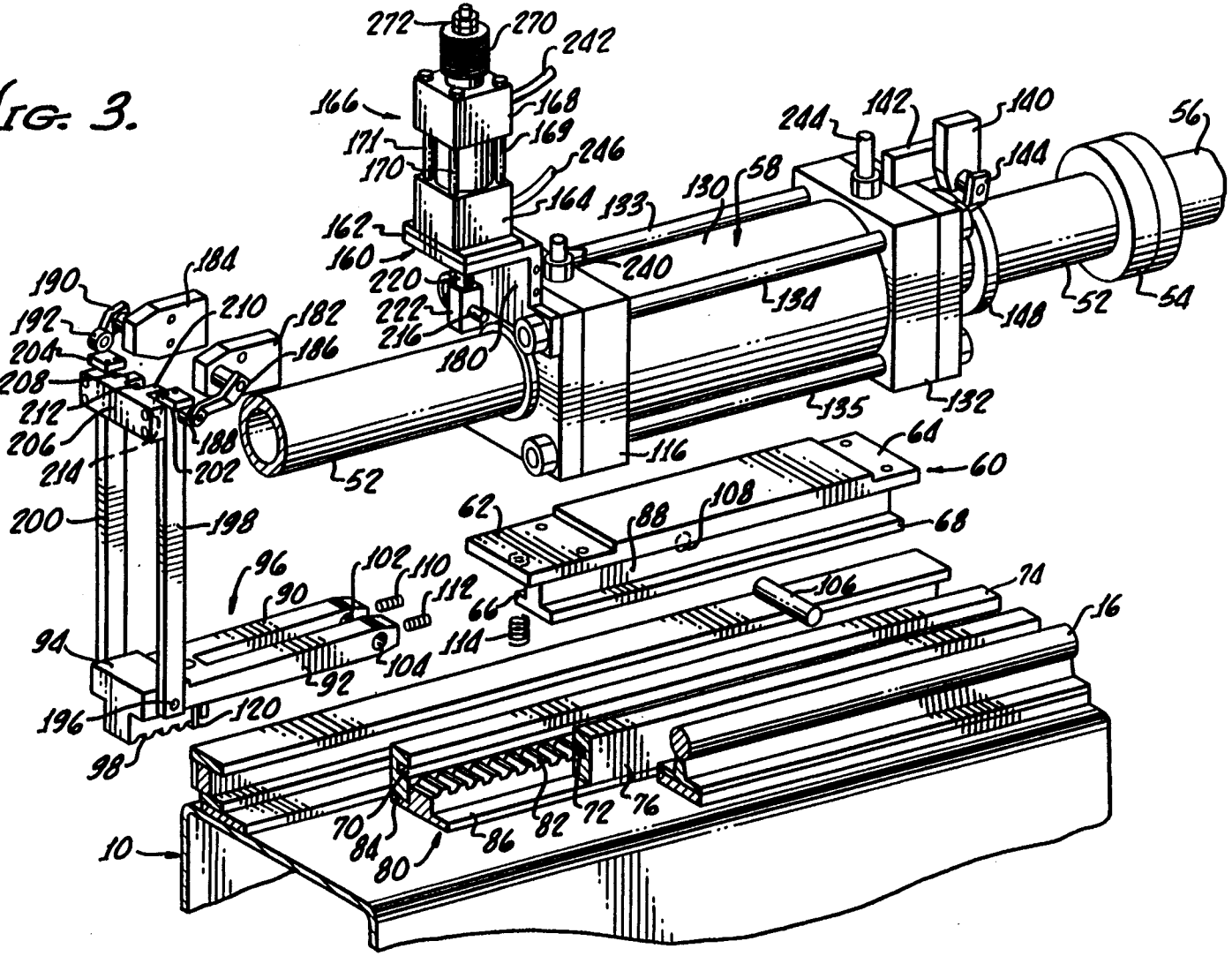
FIG. 3 is an exploded pictorial view of components of the boost cylinder system.
Figure 4:
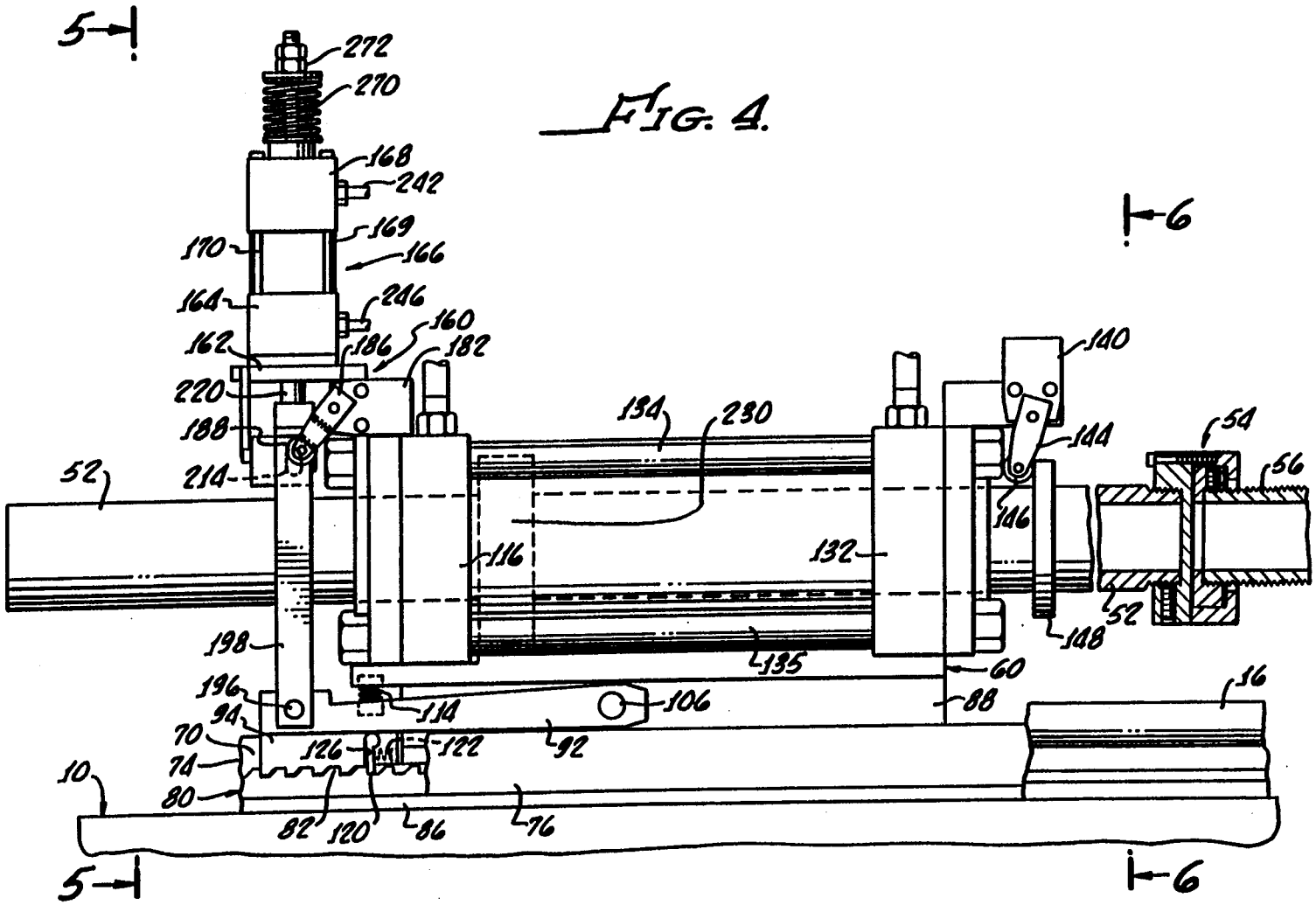
FIG. 4 is a longitudinal cross-section of the boost cylinder system of FIG. 3.
Figure 6:
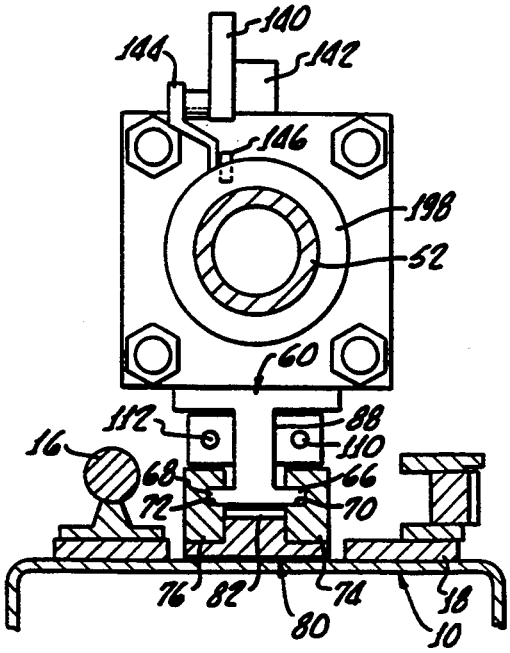

To provide a significant amount of compressive boost on the tube, in accordance with one embodiment of the present invention, there is provided a boost mechanism generally indicated at 53 that is coupled to the carriage 12. Parts of boost mechanism 53 are shown in an elongated form for clarity of this drawing. In general, boost mechanism 53 includes a boost shaft 52 that is coupled by a coupling 54 to a rearwardly extending carriage shaft 56 that is fixedly connected to the carriage 12 and normally aligned with the tube 22 that is to be bent (FIGS. 3 and 4). The boost mechanism includes a boost cylinder 58 that slidably receives boost shaft 52 and fixedly carries a cylinder support slide 60 (FIG. 3 and 6) having a general I-shaped configuration including forward and rear upper flanges 62,64 (FIG. 3) to which ends of the boost cylinder 58 are bolted. The slide includes laterally outwardly projecting lower flanges 66,68 that are received in guide slots 70,72 of first and second longitudinally extending guide rails 74,76 that are fixed to the track bed 10 and extend longitudinally for the full length of carriage movement. A rack 80, longitudinally coextensive with rails 74,76 has a series of rack teeth 82. The rack includes lower lateral flanges 84,86 that are bolted to the fixed rails 74,76 with the rack teeth 82 positioned between the rails and below the bottom of the cylinder support slide 60.

The I-shaped cylinder support slide 60 includes a longitudinally extending centrally positioned upstanding web 88 that is received between a pair of pawl support arms 90,92 that extend rearwardly from a pawl head 94 of a pivoted pawl 96. The pawl head has a longitudinally extending set of centrally located pawl teeth 98 projecting downwardly toward the rack teeth 82. Each pawl arm 90,92 is apertured at a forward end, as at 102,104 for reception of a pivot pin 106 that extends through the apertures 102,104 and through an aperture 108 extending horizontally through the slide web 88. This arrangement of pin and apertures mounts the pawl to the slide, and thereby to the cylinder 58, for a limited amount of pivotal motion about the axis of pin 106. Set screws 110,112 threaded in the ends of the pawl arms bear against pivot pin 106 to hold the pin in the pawl arms. A spring 114 captured in downwardly and upwardly facing recesses in the bottom of rear upper flange 62 of cylinder support slide 60 to and in an upper portion of the pawl adjacent the pawl head continually urges the pawl head downwardly, to move in a counter clockwise direction, as viewed in the drawing. A key 120 is carried by the pawl at a forward portion of the pawl head 94 and extends downwardly to a point just below the lower end of the pawl teeth for purposes to be described hereinafter. The key is pivoted to the pawl for limited motion about a horizontal axis and is resiliently urged in a clockwise direction by a spring 122 carried in an aperture in the pawl head. The key 120 extends downwardly through a slot 126 in the pawl head.

Boost cylinder 58 includes a hollow cylindrical body 130 fixedly connected to cylinder end blocks 116,132 by means of four long bolts including bolts shown at 133,134, and 135. The boost shaft 52 includes a piston 230. A limit switch 140 is fixedly attached on a bracket 142 secured to the cylinder end block 132 and carries a movable arm 144, having a roller 146. When the cylinder moves forwardly, toward the carriage, and relative to shaft 52, the roller 146 contacts a collar 148 fixed to the boost shaft 52 and actuates the switch.

Figure 5:
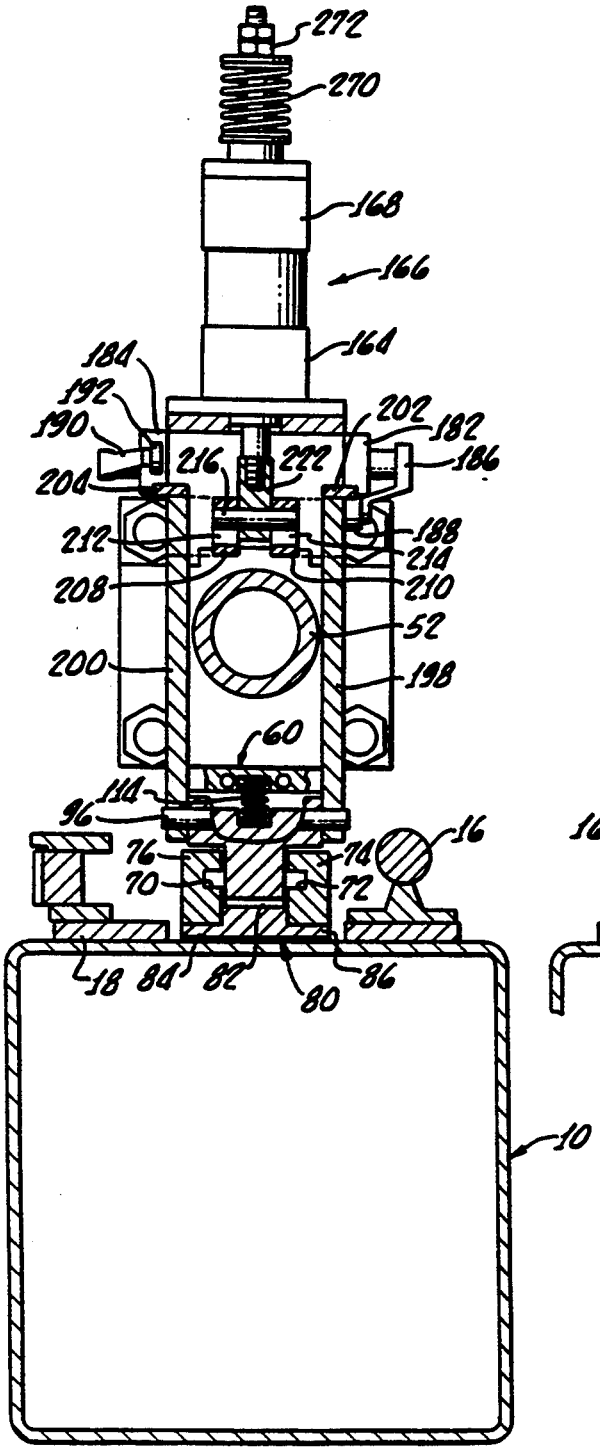
FIG. 5 and 6 are views taken on line 5—5 and 6—6 of FIG. 4.

A generally L-shaped bracket 160 is fixed to the rear cylinder end block 116 and includes a horizontal leg 162 that mounts a first end block 164 of a pawl drive or retraction cylinder 166. Pawl drive cylinder 166 is carried between end block 164 and a second end block 168 which are secured to one another by four bolts of which those identified at 169, 170 and 171 are seen in FIG. 3. Bracket 160 includes a vertical leg 180 that is fixedly bolted to the boost cylinder end plate 116 and has secured to opposite sides thereof first and second pawl position signalling switches 182 and 184. Switch 182 carries a pivotally movable arm 186 mounting a roller 188 at its end. Switch 184 carries a pivotally movable arm 190 mounting a roller 192 at its end. Pivoted to opposite sides of pawl head 94 about a horizontal axis 196 are first and second pawl drive arms 198,200, each of which carries at an upper end thereof a switch operating plate 202,204 (FIGS. 3,5). Fixed to and bridging the two upper ends of the arms 198,200 is a bracket 206 having a pair of mutually spaced bracket arms 208,210, each of which has a vertically elongated slot 212,214 that receive a pivot pin 216.

Pawl drive cylinder 166 includes a piston drive shaft 220 carrying a connecting block 222 at its lower end that extends downwardly between the pawl arms 198 and 200 and between the bracket arms 210 and 208 of bridging bracket 206. Connecting block 222 of the piston shaft 220 is formed with an aperture that receives the pivot pin 216, thereby providing a lost motion connection between the pawl cylinder piston shaft 220 and the pawl drive arms 198,200.

A compression spring 270 on the pawl cylinder piston shaft is compressed between a nut 272 on the end of the shaft and pawl cylinder end block 168 to raise the pawl whenever there is no hydraulic pressure to lift the pawl. This prevents the pawl from dragging along the rack during carriage motion and during operation that needs no carriage boost.

In operation of the described apparatus, a tube to be bent is mounted in the carriage chuck and seated on the carriage seat. The carriage boost mechanism 53 is moved, relative to the carriage, to its home position, which is the position wherein the carriage boost cylinder 58 is moved forwardly to a point closest to the carriage 12. This home position is signaled by the limit switch 140, which is actuated when the roller 146, in the course of forward motion of the carriage boost mechanism relative to the carriage is actuated by contact of the roller 146 with collar 148 that is fixed relative to the boost shaft 52. Initially the pawl drive cylinder 166 has its piston and piston shaft retracted to raise the pawl so that the entire boost mechanism is free to travel with the carriage as the latter is moved along the machine bed.

With the tube held in the carriage and carriage chuck, and with the carriage boost cylinder free to travel with the carriage without impeding carriage motion, the carriage drive motor is operated to advance the carriage and feed the tube forward to position a forward end of the tube at the bend die. The carriage boost mechanism slides freely along rails 74,76. The clamp and pressure dies are operated to close these dies against the tube. The carriage drive motor is inactivated so that the carriage is free to travel unimpeded along the machine bed.

Now a relatively low pressure is fed to a rear port 240 of the carriage boost cylinder, and an upper port 242 of the pawl lift cylinder. The pressure need not be fed to the pressure die boost cylinder at this time, but it is convenient to put all three cylinders, the pressure die boost cylinder 51, the carriage boost cylinder 58 and the pawl lift cylinder 166 on the same hydraulic line. The low hydraulic pressure provided through rearward port 240 of the carriage boost cylinder drives the boost cylinder 58 rearwardly relative to its piston 230 and relative to the carriage and boost shaft 52. At the same time the relatively low hydraulic pressure applied to the upper port 242 of the pawl retraction cylinder allows the pawl arms 198 and 200, and therefore the pawl head, to move downwardly toward the rack 80, assisted by spring 114. The pawl is lowered toward the rack so as to cause the pawl teeth to engage the rack teeth and thereby lock the carriage boost cylinder 58 to the rack. When the boost cylinder 55 is locked to the rack it is able to exert a forward boost force on the carriage and tube.

Note that the teeth are shaped to provide a vertical rear edge 311 and an upward and forwardly sloping forward edge 313 on each pawl tooth. These mate with the rack tooth, each of which has a vertical forward edge 315 and an upwardly and forwardly sloping forward edge 317. The initial low pressure applied to the carriage boost cylinder causes the latter to move rearwardly relative to the carriage and enables the pawl teeth 98 simultaneously to slide rearwardly relative to the rack teeth 82. This relative rearward motion is necessary to ensure that the pawl and rack teeth are properly engaged. Should the pawl and rack teeth be so positioned (longitudinally relative to each other) when the pawl comes down that the lowermost ends of the pawl teeth contact and rest upon the uppermost ends of the rack teeth, interengagement of these teeth cannot take place until further relative longitudinal motion shifts the pawl relative to the rack so as to allow the pawl teeth to drop into and fully engage the rack teeth.

Figure 7:
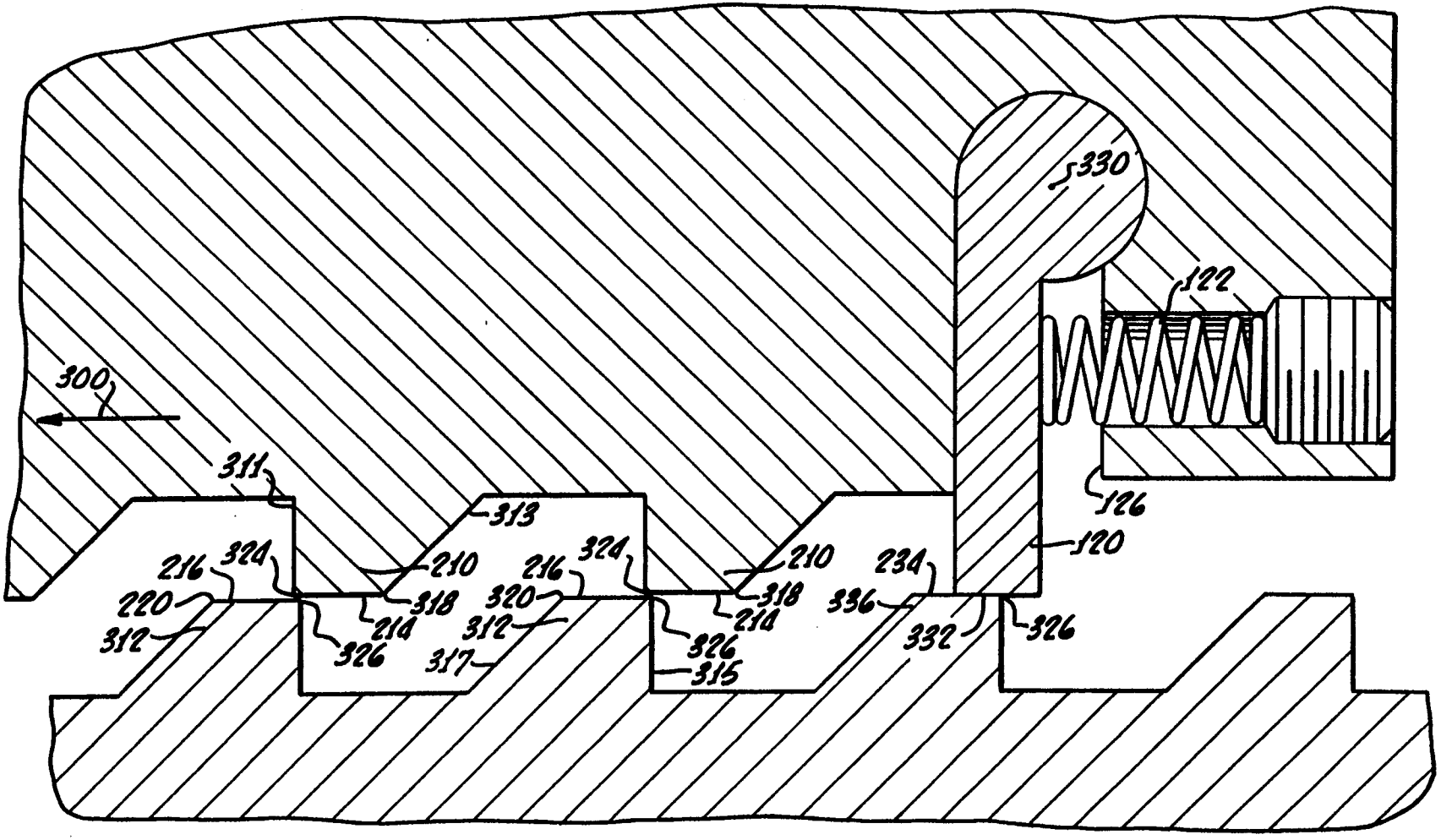
FIG. 7 is a detailed view illustrating certain aspects of operation of the pawl and rack boost cylinder latching mechanism.

FIG. 7 is an enlarged version of the relation of a pawl tooth 210 and a rack tooth 312. Should the pawl come down so that the lowermost surface 214 of pawl tooth 210 engages a significant portion (e.g. a substantial amount of contact between the horizontal surface of the teeth) of the uppermost surface 216 of rack tooth 312, the relative rearward motion of the pawl with respect to the rack will simply cause the pawl tooth surface 214 to slide rearwardly over the rack tooth surface 216 (in the direction of arrow 300) until the obtuse angle corner 318 of pawl tooth 210 slides over and beyond the obtuse angle corner 220 of rack tooth 312. The pawl will then drop down, urged by spring 114 to fully engage the rack. However, the pawl tooth may come down and engage the rack tooth in the position illustrated in FIG. 7. In this position the right angle corner 324 of the pawl tooth contacts the rack tooth adjacent the right angle corner 326 of the rack tooth with a very small amount of overlap, as indicated in FIG. 7. If initial contact occurs in this manner rearward driving of the pawl relative to the rack may cause these two corners to "hang up". In other words, the right angle corners 324 and 326 of the pawl and rack teeth may press directly against one another, tending to lock the pawl to the rack in this position of the pawl, whereby significant damage to the teeth may occur on attempted rearward motion of the pawl.

To avoid this situation, the key 120 is pivoted to the pawl head on the horizontal pivot 330 and has a lowermost end 332 which contacts the upper surface 234 of the next adjacent forward rack tooth 336. The key is positioned so that in its normal pivotal position, to where it is urged by means of spring 122, a portion of its lower surface 332 will overlap a forward end of the upper surface 234 of rack tooth 336 when the corners 324 and 326 overlap by about 1/16th of an inch or less. It is only when the latter corners overlap by a small amount, such as 1/16th of an inch or less, that the teeth may be damaged. Accordingly, should this small amount of overlap occur, the lower surface 332 of the end of key 120, which projects downwardly a slight distance below the plane of lower surface 214 of the pawl teeth, will contact the upper surface 234 of a rack tooth before the pawl teeth can contact the rack teeth, and thereby prevent the right angle corners of pawl and rack teeth from coming into a disastrous and damaging locking engagement.

As the pawl is being lowered it is also being driven rearwardly relative to the rack, and this relative rearward motion continues after the bottom of the key 120 contacts the rack surface 234. Friction of the bottom of the key 120 with the rack tooth tends to move the key relative to the pawl in a counterclockwise direction to the limit of the small amount of motion that is permitted by slot 126 in which the key is mounted. Thus the initial contact of the key with the rack tooth prior to the contact of a pawl tooth with the rack tooth prevents the damaging interlock of tooth corners, and the pawl tooth can continue its rearward motion, riding over the rack tooth until the obtuse corner 318 passes rearwardly of the obtuse corner 320 to allow the pawl teeth to drop down into the spaces between the rack teeth.

The stroke of the pawl drive cylinder is arranged so that the pawl cylinder 166 strokes to its limit when the lower surface of the pawl teeth engage the upper surface of the rack teeth. At this time the down plate 202 on pawl arm 198 has not yet contacted the roller 188 of switch 182. Spring 114 continues to urge the pawl downwardly, and when the obtuse corner 318 clears the obtuse corner 320 the force of spring 114 presses the pawl downwardly through the last amount of its downward motion. The pawl arms 198,200 move their connecting pin 216 down to the lower end of the elongated slots 212,214 in bracket arms 208,210. With this final downward increment of motion of the pawl arms switch actuator plate 202 actuates the switch 182 to signal that the pawl has been lowered to its fully locked position. Boost pressure may then be applied to the carriage boost cylinder. Accordingly, when the pawl is all the way down and locked, the pawl arm switch 182 signals that the bending may be started. This signal also may be employed to disable any carriage servo so the carriage is free to be pushed forward by the boost cylinder.

Bending is initiated by starting rotation of the bend die, together with the entire bend arm assembly. At the start of bending a high pressure is programmed into carriage boost cylinder port 240. This high pressure is also programmed into the pressure die boost cylinder and into the pawl cylinder. High pressure is not needed in the pawl cylinder for pawl lifting, but is employed merely because it is convenient to connect the pawl cylinder port 242 to the same pressure line as port 240 of the carriage boost cylinder. This high pressure may be many hundreds of psi. In a particular embodiment the high boost pressure is arranged to have a value high enough to boost the tube to be bent, but low enough to not cause damage to the carriage shaft. During the bending operation the boost pressure to port 240 of the carriage boost cylinder may be adjusted as desired to provide a desired or programmed profile of axial compressive force on the tube as it is bent.

The high pressure into boost cylinder port 240 drives the boost cylinder piston and shaft 52 to which it is affixed forwardly relative to the cylinder, which at this time is locked to the machine bed by means of the pawl and rack. The bend continues, with the bending operation tending to pull the tube and carriage forwardly, and the boost cylinder 58 forcibly urging the carriage, and thereby the tube carried thereby, forwardly and exerting a high axial compressive force on the tube as it is being bent.

At a point approximately three degrees before completion of the bend the hydraulic boost pressure into port 240 is dropped from its high level to a low level. For the remainder of the bend the forward boost pressure remains at this low level, which allows compressive stress in the tube, due to the very high compressive force previously applied thereto, to be relieved. This relief of the compressive stress in the tube before the end of the bend avoids a shock load on the carriage drive rack and other portions of the system when the bend has been completed and the clamp and pressure dies are retracted to free the tube.

At the completion of the bend, and just before retraction of the clamp and pressure dies, the boost cylinder input port is connected to zero pressure, as is a forward port 244 of the boost cylinder, to ensure that no boost pressure is applied and to relieve all tension in the tube. This avoids marking the tube when opening the clamp and pressure dies.

After connecting the boost cylinder ports to zero pressure to ensure that no further boost pressure is applied, the clamp and pressure dies are opened to release the tube. Now the pawl is raised by applying pressure to the lower input port 246 of the pawl drive cylinder. The boost cylinder is driven back toward its home position by applying pressure to the forward port 244 of the carriage boost cylinder. Shortly after starting the lifting of the pawl the carriage drive is operated to feed the tube forward to position the tube for the next bend. The low pressure is applied to the pawl lift cylinder port 246 and to the carriage boost cylinder port 244 to drive these to their home positions. As the carriage moves forwardly to advance the tube for its next bend, the boost cylinder travels, together with the carriage, and, in addition, moves forwardly relatively to the carriage toward its home position so as to be ready for the next boost. Forward motion of the carriage boost cylinder relative to the carriage stops when the boost cylinder reaches its home position that is signaled by switch 140. Similarly, when the pawl reaches its uppermost retracted position actuator plate 204 on pawl arm 200 contacts roller 192 to actuate switch 184 to signal that the pawl has been fully retracted.

When the last bend has been made the carriage remains in its forward position, and only the carriage boost cylinder and pawl lift cylinders are retracted. Then the first tube is removed, the next tube is loaded into the carriage and chuck, and the carriage and tube are then positioned in the first bending position. The clamp and pressure dies are then closed, and the previously described series of steps is repeated.

For a bending machine in which the tube will move axially during any single bend by a distance of seven inches, for example, the carriage boost cylinder is provided with a stroke of somewhat more than seven inches, such as for example nine inches, to ensure that the carriage boost cylinder will not reach the end of its stroke before the tube has moved its fully longitudinal distance during a bend.

There has been described a system for providing axial compressive force on a tube during a bending operation without hampering carriage movement by use of a boost cylinder coupled to the carriage and selectively locked to the machine bed during a bend operation so that boost force may be applied only during the bend operation.

What is claimed is:

1. A method for exerting axial compressive force on a tube carried by a carriage, the carriage mounted to a machine bed having a bend head for bending of the tube, said method comprising:

driving the carriage along the machine bed to position the tube at the bend head prior to a bending operation, moving a boost motor with the carriage as the carriage is driven along the machine bed prior to the bending operation, locking the motor to the machine bed bending the tube with the motor locked to the machine bed, and operating the motor to cause it to exert an axial boost force on the tube during the bending operation of the tube.

2. The method of claim 1, wherein the machine bed extends in a longitudinal direction with the bend head located at a forward portion of the machine bed and wherein the driving step comprises driving the carriage and the tube in a longitudinally forward direction toward the bend head.

3. The method of claim 2 wherein said step of moving a boost motor comprises securing a rearwardly extending boost shaft to the carriage, and mounting the boost motor on the boost shaft.

4. The method of claim 3, wherein the boost shaft and tube are aligned.

5. The method of claim 3 wherein the step of mounting the motor on the boost shaft comprises slidably mounting an hydraulic cylinder on the boost shaft and fixing a motor piston to the boost shaft within the cylinder.

6. The method of claim 1 wherein said locking step comprises fixing a rack to the machine bed, pivotally mounting a pawl on the motor and moving the pawl into engagement with the rack.

7. Bending apparatus comprising:

a machine bed that extends in a longitudinal direction, a bend head connected with a forward portion of said bed, a carriage mounted on the bed for forward motion toward the bend head and rearward motion away from the bend head, said carriage including tube holding means for pressing against an end of a tube to be bent, a boost motor mounted on the machine bed, means for coupling the boost motor with the carriage for motion therewith relative to the machine bed, and means for selectively locking said boost motor to the machine bed, wherein said boost motor includes means responsive to operation of the boost motor for exerting a forwardly directed boost force on a tube held by the carriage.

8. The bending apparatus of claim 7, wherein said coupling means includes a boost shaft fixed to the carriage and extending rearwardly thereof, said boost motor being slidable on said boost shaft.

9. The bending apparatus of claim 8, wherein said boost motor responsive means includes a cylinder slidable on said boost shaft and a piston within said cylinder fixed to said shaft.

10. The bending apparatus of claim 7 wherein said means for selectively locking said boost motor comprises a rack fixed to said bed and a pawl movably carried by said motor for motion between a locked position in which the pawl engages the rack and an unlocked position in which the pawl is free of the rack.

11. For use with a bending machine in which a tube holding carriage is slidably mounted on a machine bed for moving the tube forwardly toward a bend head on an end of the bed, a method of exerting a forward boost force on the carriage to cause the carriage to exert an axial compressive force on a tube held by the carriage as the tube is bent by the bend head, said method comprising the steps of:

coupling a rearwardly extending boost shaft to the carriage, slidably mounting a boost cylinder on the boost shaft, fixing a piston to the boost shaft within the cylinder, fixing a toothed rack to the machine bed, pivotally mounting on the boost cylinder a toothed pawl having teeth capable of engaging teeth of the rack in a position that prevents motion of the pawl and boost cylinder rearwardly relative to the rack, driving the carriage to position the tube for bending at the bend head, moving the pawl into engagement with the rack to latch the cylinder to the rack, operating the bend head to bend the tube, and while the bend head is operated to bend the tube, pressurizing the boost cylinder to drive the piston, boost shaft and carriage forwardly.

12. The method of claim 11 wherein said step of operating the bend head comprises the steps of clamping the tube between a bend die and a clamp die and rotating the dies through a predetermined angle, and including the step of decreasing the pressurizing of said boost cylinder before the bending of the tube is completed and while the tube is still clamped to the clamp die.

13. The method of claim 12 including the steps of releasing the tube from the clamp die upon completion of a bend and after decreasing pressure in said boost cylinder, retracting the pawl, and moving the carriage and the tube to position another section of the tube at the bend head.

14. The method of claim 13 including the step of moving said boost cylinder toward said carriage while the carriage and tube are moved forwardly to position another section of the tube at the bend head.

15. The method of claim 11 wherein said step of moving the pawl into engagement with the rack comprises the step of pressurizing the cylinder with a relatively low pressure to drive the cylinder and pawl rearwardly away from the carriage, and urging the pawl downwardly toward the rack as the cylinder is moved rearwardly, thereby enabling the pawl teeth to interengage with the rack teeth.

16. The method of claim 15 including the step of preventing engagement of a corner of a tooth of the pawl with a corner of a tooth of the rack.

17. The method of claim 16 wherein the step of preventing engagement comprises interposing a key between the pawl and rack.

18. The method of claim 16 wherein said step of preventing engagement comprises contacting a tooth of said rack with a key pivoted to said pawl.

19. Bending apparatus comprising:

a machine bed, a bend head at a part of said bed, a carriage mounted on the bed for motion toward and away from the bend head, a boost cylinder slidably mounted on said bed for motion toward and away from the carriage, a boost shaft fixed to the carriage and extending axially into said boost cylinder, a piston fixed to said boost shaft and positioned within said cylinder, whereby pressurization of the cylinder on one side or the other of said piston drives said boost shaft and carriage in one direction or the other relative to said cylinder, and locking means for selectively locking said cylinder to said machine wherein said locking means comprises a rack fixed to the bed and a pawl movably mounted on the cylinder.

20. The bending apparatus of claim 18 wherein said pawl comprises a toothed member pivoted to said cylinder and having a free end, a pawl lift arm pivoted to said pawl free end, a pawl lift cylinder mounted on said boost cylinder and having a driven piston rod, and a lost motion connection between said driven piston rod and said pawl lift arm.

21. The bending apparatus of claim 20 including means for urging said pawl lift arm upwardly.

22. The bending apparatus of claim 20 including spring means connected to said piston rod to urge said piston rod and pawl lift arm upwardly.

23. The bending apparatus of claim 20 wherein said rack and said pawl each have teeth having ends defined by sharp corners and obtuse corners, and including means for preventing a sharp corner of a pawl tooth from engaging a sharp corner of a rack tooth.

24. The bending apparatus of claim 23 wherein said means for preventing comprises a key pivoted to said pawl and having an end extending toward said rack beyond an end of the pawl teeth, including means for pressurizing the cylinder to drive the cylinder and pawl rearwardly of the rack, and means for urging the pawl toward the rack as the cylinder and pawl are moved rearwardly relative to the rack.

* * * * *